US005420581A

United States Patent [19]

Peters et al.

[11] Patent Number: 5,420,581

[45] Date of Patent: May 30, 1995

[54] MATERNAL SOUND LEVEL DEVICE AND METHOD FOR PROTECTING FETAL HEARING

[75] Inventors: Aemil J. M. Peters; Byron J. Masterson; Robert M. Abrams, all of Gainesville, Fla.

[73] Assignee: BodySonics, Inc., Houston, Tex.

[21] Appl. No.: 66,573

[22] Filed: May 26, 1993

[51] Int. Cl.[6] ..... G08B 23/00

[52] U.S. Cl. ..... 340/573; 73/646; 73/645; 340/600

[58] Field of Search ..... 340/573, 600, 407.1, 340/407.2, 407; 73/645, 646, 432.1; 367/199, 198; 434/112

[56] References Cited

U.S. PATENT DOCUMENTS

| | | | |
|---|---|---|---|
| 3,696,206 | 10/1972 | Ida | 73/646 |
| 3,778,552 | 12/1973 | Edinborgh | 73/645 |
| 3,789,952 | 2/1974 | Widegren | 73/645 |
| 4,064,362 | 12/1977 | Williams | 179/1 |
| 4,277,980 | 7/1981 | Coats | 73/646 |
| 4,297,677 | 10/1981 | Lewis | 340/407.1 |
| 4,319,081 | 3/1982 | Martin | 340/407.1 |
| 4,538,296 | 8/1985 | Short et al. | 381/72 |
| 4,654,642 | 3/1987 | Groff | 73/646 |
| 4,827,458 | 5/1989 | D'Alayer de Costemore D'Arc | 367/136 |
| 5,072,415 | 12/1991 | Cannelli et al. | 364/556 |
| 5,093,658 | 3/1992 | Grothause | 340/825.44 |
| 5,109,421 | 4/1992 | Fox | 381/90 |
| 5,119,426 | 6/1992 | Roberts | 381/56 |

OTHER PUBLICATIONS

Brody, Jane E., "Sounds and the Fetus", *The New York Times,* Mar. 31, 1993.

Peters, Aemil J. M., et al., "Fetal Vibroacoustic Stimulation Test: Vibrator Response Characteristics in Pregnant Sheep Postmorten", *Obstetrics & Gynecology,* vol. 81, No. 2, Feb. 1993, pp. 181–184.

Robb, Vicki, "UF research in sheep indicates how sounds reach fetus in womb", *The Friday Evening Post,* University of Fla., Health Science Center Communications, Gainesville, Fla., p. 2, Oct. 9, 1992.

(List continued on next page.)

*Primary Examiner*—John K. Peng
*Assistant Examiner*—Albert K. Wong
*Attorney, Agent, or Firm*—Maryam Bani-Jamali

[57] ABSTRACT

The present invention is a maternal sound level device that functions to protect fetal hearing by alerting the mother whenever her fetus is exposed to sound pressure levels (SPL) which exceed predetermined levels. The device is comprised of a microphone (14) for SPL detection, preamplifier (2), weighting network (4), level detector (6), and alarm mechanism (8). This device is battery operated and can be easily clipped on a belt so as to be worn by pregnant women at the abdominal level to monitor SPL at the abdomen. SPLs are measured in the range of greater than 80 dB and less than 100 dB over a frequency range of greater than 30 Hz and less than 10,000 Hz. The mother is alerted to SPLs that are exceeding a predetermined level to protect the hearing of the mother's developing fetus by a visual and/or a mechanical alarm. A distinguishing feature of the invention is the weighting network which enhances low frequency SPLs (greater than 30 Hz and less than 1000 Hz) by greater than 5 dB and less than 15 dB and attenuates high frequency SPLs (greater than 1000 Hz). In a preferred embodiment, an alarm signal will be presented to the user of the device when sound pressure levels in the vicinity of the user are greater than 80 dB at frequencies between greater than 30 Hz and less than 1000 Hz, with gradually increasing SPLs required with higher frequency such that 100 dB SPL is required to produce an alarm at greater than 4000 Hz and less than 5000 Hz.

22 Claims, 3 Drawing Sheets

OTHER PUBLICATIONS

Richards, Douglas S., et al., "Sound Levels in the Human Uterus", *Obstetrics & Gynecology,* vol. 80, No. 2, Aug. 1992, pp. 186–190.

Peters, A. J. M., et al., "Resonance of the Pregnant Sheep Uterus", *J. of Low Frequency Noise & Vibration,* vol. 11, No. 1 (1992) pp. 1–6.

Peters, Aemil J. M., et al., "Three Dimensional Sound and Vibration Frequency Responses of the Sheep Abdomen", *J. of Low Frequency Noise & Vibration,* vol. 10, No. 4 (1991) pp. 100–111.

Peters, Aemil J. M., et al., "Vibration of the Abdomen in Non-Pregnant Sheep: Effect of Dynamic Force and Surface Area of Vibrator", *J. of Low Frequency Noise & Vibration,* vol. 10, No. 3, (1991) pp. 92–99.

Gerhardt, Kenneth J., "Prenatal and Perinatal Risks of Hearing Loss", *Seminars in Perinatology,* vol. 14, No. 4, Aug. (1990), pp. 299–304.

Lalande, Nicole M., et al., "Is Occupational Noise Exposure During Pregnancy a Risk Factor to the Auditory System of the Fetus", *Am. J. of Indus. Med.,* 10:427–435 (1986).

Gerhardt, K. J., et al., "Cochlear Microphonics Recorded From Fetal and Newborn Sheep", *Am. J. of Otolaryngology,* vol. 13, No. 4, Jul.–Aug. (1992), pp. 226–233.

MATERNAL SOUND LEVEL DEVICE AND METHOD FOR PROTECTING FETAL HEARING

BACKGROUND OF THE INVENTION

I. Field of Invention

The present invention relates to a device that warns a pregnant woman when sound pressures are present that may be exceeding a predetermined level to protect the hearing of a pregnant woman's developing fetus.

II. Brief Description of the Prior Art

Seven million workers in the United States are currently exposed to occupational noise. A growing number of these workers are pregnant women. While rather rigid regulations are in force concerning hearing conservation in all workers, including pregnant women, no guidelines are yet available on level and duration of noise exposure for fetuses in utero. Furthermore, high levels of sound pressures are present during recreational activities such as boating and motorcycling. It is known that sounds readily penetrate the uterus, and that sounds of low frequencies can actually be louder inside than outside. Preliminary data suggest that intense sound pressures result in disruption of fetal sleep state and altered fetal hearing sensitivity.

Recent studies by Lalande ["Is Occupational Noise Exposure During Pregnancy a Risk Factor of Damage to the Auditory System of the Fetus?" Nicole M. Lalande, Ph.D., Raymond Hetu, Ph.D., and Jean Lambert, Ph.D. *American Journal of Industrial Medicine,* 1986; 10:427–435] showed hearing loss in children of mothers who were exposed to noise in the workplace. This hearing loss was greatest when low frequencies were present in the exposure.

Low frequencies can be enhanced within the abdominal cavity of humans as recently documented by Richards ["Sound Levels in the Human Uterus", Douglas S. Richards, M.D., Barbara Frentzen, M.S.N., Kenneth J. Gerhardt, Ph.D., Mary McCann, M.A., and Robert M. Abrams, Ph.D., *Obstetrics and Gynecology,* 1992; 80:186–190], and the presence of low frequency sound pressures can be considered as more harmful to the developing ear than to the adult ear. However, significant attenuation above frequencies of 1000 Hz occurs in the fluid-filled inner ear structures of the fetus ["Cochlear Microphonics Recorded from Fetal and Newborn Sheep", Kenneth J. Gerhardt, Ph.D., Randal Otto, M.D., Robert M. Abrams, Ph.D., Joy J. Colle, M.A., David J. Burchfield, M.D., and Aemil J. M. Peters, *American Journal of Otolaryngology,* July–August, 1992; 13(4):226–233].

Existing sound level meters often incorporate a weighting network to calculate pressures that may be harmful to the human adult ear including higher frequencies. Regulations use dB(A) weighting networks that reduce the contribution of low frequencies for calculating sound pressure levels. Thus, existing sound level meters do not reflect the possible pressure in the vicinity of a human fetal head.

SUMMARY OF THE INVENTION

The present invention comprises a maternal sound level device for protecting fetal hearing to be worn by a pregnant woman at the abdominal level. The invention incorporates a network that is specifically adapted to inversely mimic the attenuation of sound by the abdominal wall, uterus, fluids, and fetal inner ear structures. The apparatus comprises a small microphone which converts sound pressure variations as measured at the abdominal level into voltage variations. These voltage variations are amplified by a preamplifier and the output signal of this preamplifier is connected to a filter that acts as a weighting network by reducing the levels of higher frequencies relative to lower frequencies. The output of this filter is fed into an amplifier that may also be adapted to further emphasize the low frequencies. The output of this amplifier is fed into a level comparator which can comprise an averager with a short time constant to eliminate false alarms by short lasting peak pressures. The output of the level comparator is then fed into an alarm circuit, which can include visual, acoustical, or vibrating alarms, or a combination of different alarms, which are activated when sound pressure levels are detected that exceed a predetermined level, which may optionally be made adjustable. Because various alarms can be used, a unit may be easily adapted for use by visual or auditory handicapped persons.

Once an alarm is perceived by a pregnant woman using the device or by others in the vicinity, the woman can remove herself and thereby the fetus from the possible hazardous site where sound pressures exceed the predetermined levels.

Another advantage of the device is its portability, which allows the monitoring of sound pressures continuously while engaged in such occupational activities as driving a school bus or working in a textile factory and while engaged in recreational activities in which whole body sound and vibration exposures are common, such as music concerts and boating. Another important advantage of the device is the fact that it is intended to be worn at the abdominal level, near the target location, namely the fetus. It can, however, be physically detached from the user if necessary, allowing measurements within a restricted area to be valid.

Additional advantages can be learned from the drawings and ensuing description and it is to be understood that the invention is not limited to the particular embodiment shown in the accompanying drawings or the description of the particular embodiment provided below.

BRIEF DESCRIPTION OF THE DRAWINGS

FIG. 1A is a front view of the preferred embodiment,

FIG. 1B is a side view, and

FIG. 1C is a rear view;

DESCRIPTION OF THE PREFERRED EMBODIMENT

Mechanical Portion

Figure 1A:
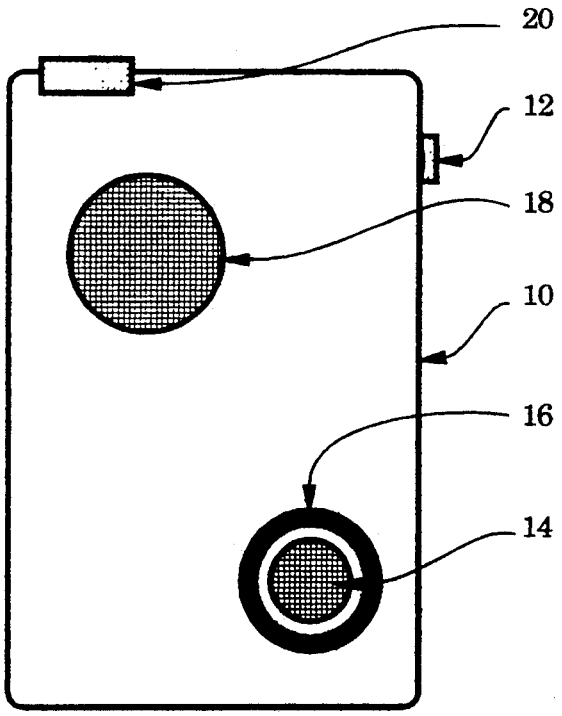
FIGS. 1A–C show three views of a preferred embodiment of the invention showing the position of the different components that comprise the unit.

By referring to FIG. 1A, front view, it can be understood that the device comprises an enclosure 10 that has dimensions of a portable unit preferably measuring 9 cm×6 cm×3 cm which reflect height, width and depth, respectively. The enclosure 10 is made of plastic or a light weight metal such as aluminum and is to be used in conjunction with existing clothing material such as a pair of slacks, a drape and/or a belt, therefore not making skin contact with the user. The unit can be switched on for operation with switch 12 and switched off by the same switch 12. The device is intended to be worn by a pregnant woman with the microphone 14 facing away from the user and towards a possible sound source.

The microphone 14 can be an electret type or a small sensitive dynamic microphone and is housed in a rubber insulator 16. The insulator 16 prevents the vibrations that would result in a signal detected by the microphone 14 within the materials of the enclosure 10 which are made by touching this enclosure 10 (e.g., knocking on the enclosure 10 with a hand) or by movements induced by repositioning the device for comfort or by clothing touching the enclosure 10 with a certain force.

A buzzer 18 is provided, generating a pulsating high pitched sound which is activated for several seconds when the sound pressures in the vicinity of the user exceed predetermined levels. Conventional electronic circuitry (not shown) may be used to produce the pulsations. The buzzer 18 is preferably a magnetic or piezoelectric type or any other type that emits a clear and loud high-pitched acoustical signal directed in one direction only. A high-pitched buzzer is preferred because higher frequencies are more attenuated by the abdominal wall and underlying structures; therefore, the fetus is not exposed to hazardous sound levels exceeding a predetermined level. A commercially available buzzer suitable for use in the preferred embodiment is available from Radio Shack Corp. as Model No. 273-026. This buzzer model emits sounds with a frequency of 3.4 kHz (±0.5 kHz).

Sound pressures produced by buzzer 18 are specifically intended to be louder than the acoustical program surrounding the user of the device so that the user will be alerted to a possible hazardous condition wherein sound levels exceed a predetermined level. The sound that the buzzer 18 emits is pulsating and high pitched in character such that maximum attention is derived from the user because it is believed that pulsating high pitched sounds are more alarming as compared to continuous sounds. The preferred buzzer 18 directs its acoustical emission in one direction only, and is preferably mounted so that the direction of acoustic emission is forward and away from the abdominal segment to further reduce the possibility of exposing the fetus to loud sounds exceeding a predetermined level, while retaining the ability to alert the pregnant woman, even in the presence of high ambient noise. The buzzer 18 is intended to be mounted within the enclosure 10 of the device in such a manner that minimum coupling exists between buzzer 18 and enclosure 10 so that vibroacoustic stimulation of the enclosure 10 coupled to the abdominal segment can be considered as minimal, since vibroacoustic devices placed on the skin of the abdominal wall can introduce sound pressures in the fetal environment and therefore possibly expose the fetus to unwanted sounds exceeding a predetermined level. [Fetal Vibroacoustic Stimulation Test: Vibrator Response Characteristics in Pregnant Sheep Postmortem," Aemil J. M. Peters and Robert M. Abrams, Ph.D., Obstetrics and Gynecology 1993, 81:181–184]. To accomplish this purpose, the buzzer 18 is mechanically isolated from enclosure 10 by mounting the buzzer 18 on a separate isolated board inside enclosure 10 and by avoiding mechanical contact with enclosure 10 at the point from which acoustic emission takes place, which is the front of enclosure 10 (see FIG. 1A, front view).

A flashlight 20 is provided which consists of one or more light emitting diodes (LED) or a small high intensity light bulb. The flashlight 20 provides a visual alarm that will be activated whenever the buzzer 18 is activated and will be of great help in alarming the user in dark and noisy environments, as in mining industries, or during work at night hours. Additionally, the flashlight 20 is useful in an environment where intense noise exposure is already present so that maternal hearing is limited and thus the acoustical alarm of the buzzer 18 alone may not be sufficient to alarm the user.

The device could be built with the option for the user to select either the buzzer 18 or flashlight 20 or both, to be activated as alarm detectors. The flashlight 20 and the on-off switch 12 are chosen so as not to exceed the dimensions of the enclosure. The device is not attached to the body by means of skin contact of the user no matter how the enclosure is mounted. The device can be worn on any clothing as used during recreational activities and during professional activities that require special protective clothing. The mechanical dimensions of the device make it therefore possible to use the device as a portable device. The device may be worn in the pockets of existing clothing, or as further illustrated in FIG. 1C, two belt supporters 22 provide support to use the device with an existing belt or in the case of a wider belt or a pair of slacks, a belt clip 24 is provided, thereby maximizing mounting possibilities of the device to the human body. The flashlight 20 will be observed no matter how the enclosure is placed or if detached from the body: on its front or back surfaces or on any of its lateral sides. A battery compartment 26 is easily accessible for replacement of the battery by removing the cover of the compartment 26.

Electronic Portion

Figure 2:
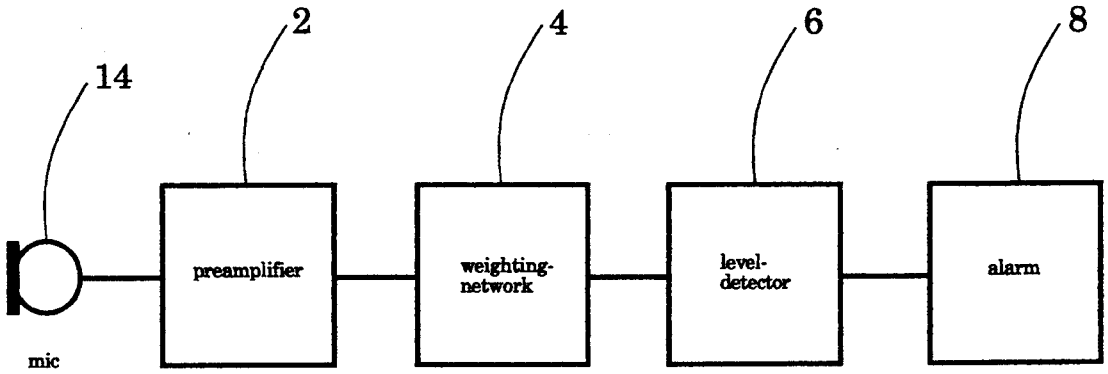
FIG. 2 shows a block diagram of the electrical circuitry of the preferred embodiment.

FIG. 2 is a block diagram of a device in accordance with the present invention. This device comprises a microphone 14, for sound pressure level (SPL) detection, a preamplifier 2, a weighting network 4, a level detector 6, and an alarm mechanism 8. In the preferred embodiment, SPLs are measured in the range of greater than 80 dB and less than 100 dB over a frequency range of greater than 30 Hz and less than 10,000 Hz. The mother is alerted to SPLs that are exceeding a predetermined level to protect the hearing of the mother's developing fetus by the alarm mechanism 8. Weighting network 4 preferably enhances low frequency SPLs (greater than 30 Hz and less than 10,000 Hz) by 10 dB and attenuates high frequency SPLs greater than 1000 Hz at a rate of 12 dB/octave.

Figure 1C:
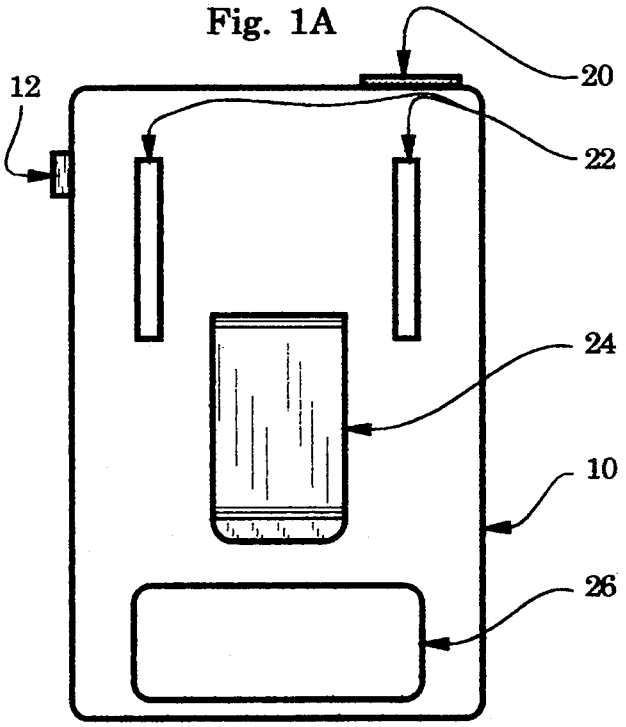
Figure 1B:
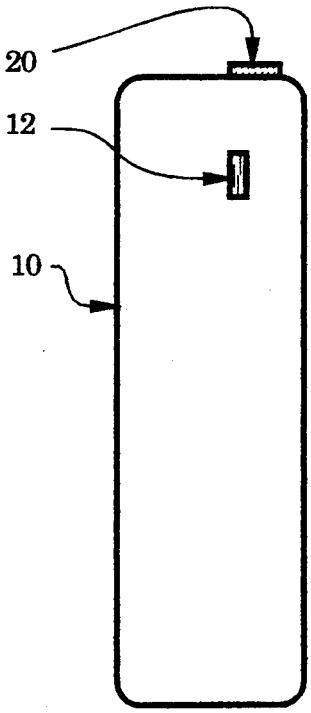
Figure 3:
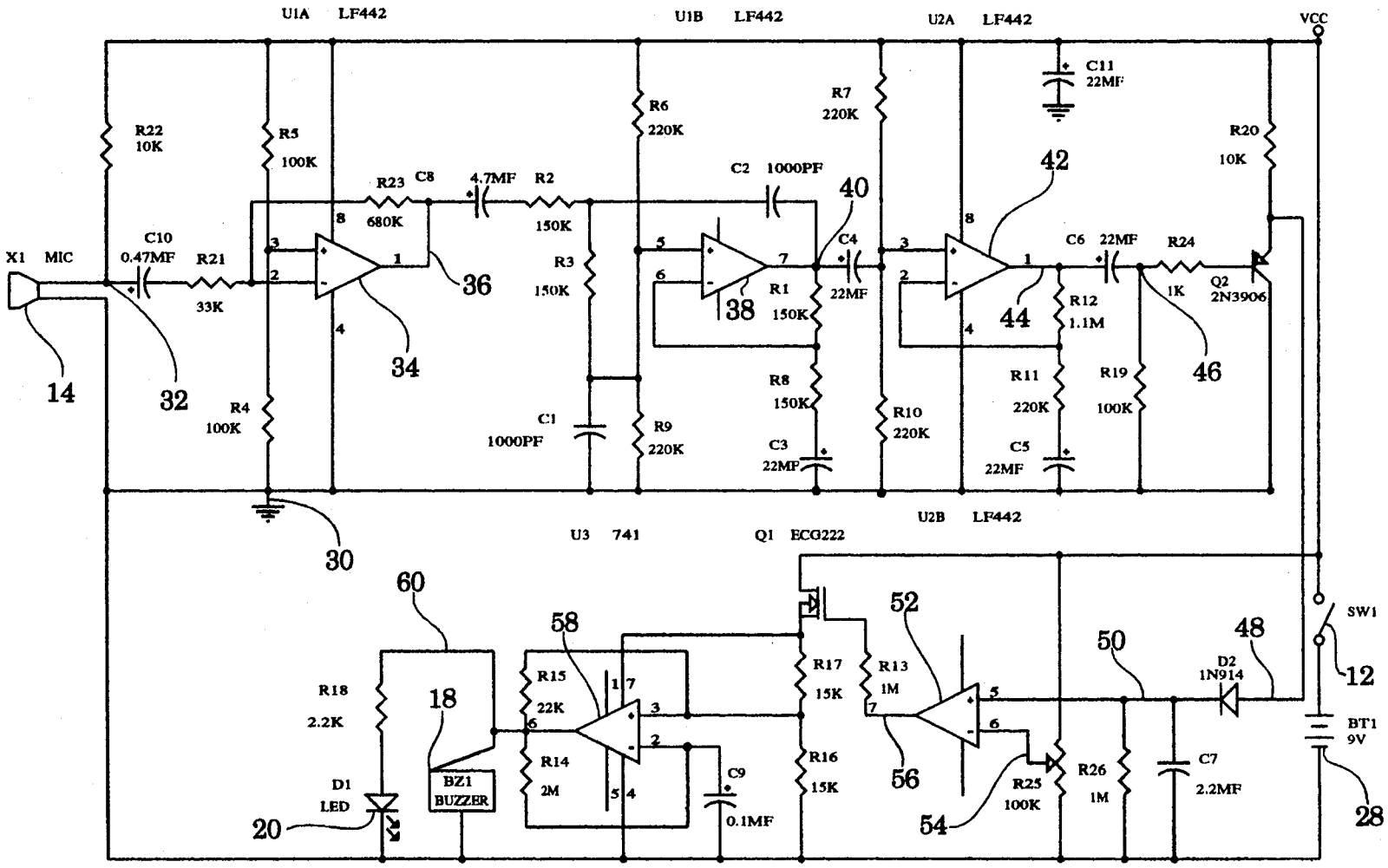
FIG. 3 shows a detailed electrical schematic diagram of the preferred embodiment.

Referring now to FIG. 3, as well as to FIGS. 1A–C, the electronic circuit which resides in the enclosure 10 is on a printed circuit board (not shown) and is connected to a battery 28 which is put in series with the on-off switch 12 to activate the circuitry. Operational amplifiers 34, 38, 42, and 52 are of any low current type with a bandwidth suitable for audio amplification. Because of the low current used, the preferred embodiment can operate using a standard 9-volt transistor radio battery for more than 40 hours. In the preferred embodiment, National Semiconductor LF442 amplifiers are used, which provide two operational amplifiers per package. Operational amplifier 58 is an operational amplifier capable of supplying sufficient output current to drive buzzer 18. In the preferred embodiment, operational amplifier 58 is industry standard type 741 operational amplifier. A microphone 14 is connected with one terminal to circuit ground 30 and with the positive terminal through resistor R22 to the positive side of a 9 volt battery 28 when the on-off switch 12 is closed. An omnidirectional electret condenser microphone, such as Radio Shack Model 270-090 may be used for microphone 14. This microphone has a flat frequency response (±6 dB) at a frequency greater than 30 Hz and less than 10,000 Hz and decreases in sensitivity at a frequency greater than 10,000 Hz or less than 30 Hz. Therefore, frequencies less than 30 Hz or greater than 10,000 Hz are not evaluated in the preferred embodiment. (While it may be more preferable to measure SPL frequencies outside this range as well, a more expensive microphone would be required. In addition, SPLs at such frequencies sufficient to endanger a fetus are rare in normal environments.) Resistor R22 is applied to provide current to microphone 14. Biasing of microphone 14 is necessary if the Radio Shack Model 270-090 microphone is used, since a field-effect transistor is an integral part of the Model 270-090 microphone and resides within its housing. The value of resistor R22 was selected in conjunction with the Model 270-090 microphone to achieve maximum sensitivity of microphone 14 as well as minimum current drainage from the battery 28. The power supply voltage is adequate to power the active devices in the circuit and to provide power to the buzzer 18 and the flashlight 20. Capacitor C11 stabilizes the powering voltage of the circuitry. The microphone signal on line 32 is coupled through a capacitor C10 and resistor R21 to an amplifier 34 of which gain is determined by the ratio of resistors R23 and R21, which in the preferred embodiment is approximately 20. This gain is selected to provide enough amplification of the microphone signal on line 32 such that after amplification by amplifier 34, the signal on line 36 can be filtered by the low-pass filter built around amplifier 38. The gain is furthermore selected to be approximately 20 such that sound pressures as detected by microphone 14 result in signals on lines 36, 40, 44 and 48 that are not clipping over the entire preferred range and preferred sound pressure level range to be measured by the device. Amplifier 34 also buffers the microphone signal on line 32. Since only one single 9 volt battery 28 is applied, an offset is provided for the amplifier 34 by resistors R5 and R4 such that half of the battery voltage is present as a DC-offset at the input of the amplifier 34. The output of this amplifier 34 is on line 36 and is coupled by a coupling circuit consisting of capacitor C8 and resistor R2 to a weighting network built around the amplifier 38 which is configured as a low pass filter. The preferred filter has a cut-off frequency of approximately 1000 Hz (±100 Hz) and a rolloff rate of approximately 12 dB/octave. The filter characteristics of the weighting network 4 thus determine at which levels an alarm will be presented. In the preferred embodiment, an alarm will be presented by buzzer 18 and flashlight 20 when sound pressures exceed 80 dB at a frequency greater than 30 Hz and less than 1000 Hz. At a frequency greater than 1000 Hz and less than 4000 Hz, a gradually increasing sound pressure is required to evoke an alarm as presented by buzzer 18 and flashlight 20 and is approximately 100 dB at a frequency greater than 4000 Hz and less than 5000 Hz.

The cutoff frequency is determined by resistors R1, R2, R3 and R8 and capacitors C1 and C2 in the preferred embodiment, however, other filter arrangements can be used and will be apparent to those skilled in the art. To provide a sensitivity characteristic suitable for protecting fetal hearing, the cutoff frequency should be in a range of greater than 400 Hz and less than 1500 Hz, with greater than 800 Hz and less than 1200 Hz preferred. The resistors and capacitors in the preferred embodiment are selected to provide a cutoff frequency of 1000±100 Hz. The filter should have greater than 15 dB and less than 20 dB greater gain at 1000 Hz than at 4000 Hz to provide the desired sensitivity characteristic for the protection of fetal hearing. This characteristic may be altered by selecting different values of filter resistors and capacitors; however, for protection of fetal hearing, the rolloff above the cutoff frequency should be maintained preferably greater than 6 dB and less than 18 dB per octave. (Assuming the low frequency sensitivity is properly adjusted, rolloffs less than 6 dB per octave are likely to give many false alarms due to high frequencies and rolloffs greater than 18 dB per octave are insufficiently sensitive to high frequencies to reliably provide alarms when potentially dangerous high frequency noises are present.) The preferred characteristic takes into account that low frequencies can be enhanced within the abdomen by 10 dB and high frequencies can be attenuated 20 dB once sounds reach the fetal inner ear structure. Capacitor C3 functions to decouple one of the inputs of this amplifier 38 of DC. Resistors R6 and R9 are provided to give the input stage of amplifier 38 a DC-offset of half the battery voltage.

The signal on line 40 which is the output of amplifier 38 is coupled by capacitor C4 to an amplifier 42 which has a DC offset on one of the inputs of half the battery voltage as provided by resistors R7 and R10. The gain of amplifier 42 is determined by the ratio of the resistors R12 and R11, and is selected to be greater than 5 and less than 6. This gain structure of amplifier 42 is chosen to provide a strong enough signal on line 44 to be fed into an averager built around transistor Q2. Capacitor C5 decouples one of the inputs from DC. The output of the amplifier 42 is the signal on line 44 and put through coupling capacitor C6 into the averager built around transistor Q2, which, in the preferred embodiment, is an industry standard PNP type 2N3906. This averager has a time constant preferably in the range of greater than 1 second and less than 3 seconds to reduce the possibility of false alarms. Thus, alarms caused by short-lasting peak sound pressures such as those caused by stamping of feet, knocking the unit into a door post, or temporarily speaking loudly, are avoided. Resistors R24, R19 and R20 ensure correct biasing for the signal on line 46.

After buffering of the signal on line 46 by transistor Q2, the signal as on line 48 is then rectified by diode D2, which performs half-wave rectification In the preferred embodiment, this is a small-signal silicon diode, type 1N914. Capacitor C7 and resistor R26 are functioning as a smoothing low pass filter and provide a time constant, the purpose of which is to provide, for a sustained period of time (greater than 1 second and less than 3 seconds), an increased voltage on line 50 and thus at the input of level comparator 52 if sound pressures are increased as detected with the microphone 14. This time constant was chosen to be approximately 2 seconds in the preferred embodiment since the time constant avoids false alarms caused by short-lasting peak sound pressures and provides a time period of ±2 seconds that the alarm is presented by buzzer 18 and flashlight 20 if sound pressures are exceeding predetermined levels as detected by microphone 14. The signal on line 50 is fed into the level comparator 52 which compares the signal on line 50 to a predetermined voltage which is present on line 54 and set by adjustable resistor R25. The output level of comparator 52 is present on line 56 and changes in voltage when the signal on line 50 exceeds a level previously set by the variable resistor R25 on line 54. By applying this variable resistor R25 one can therefore alter the level at which the device will alarm the user that sound pressures have exceeded predetermined levels. In the preferred embodiment, the alarm levels can be set to nominal levels corresponding to sound levels of 80 dB at 100 Hz and 100 dB at 4000 Hz (dB ref 20 μPa), with an adjustment range to permit adjustment to the user's preferences of safety levels. The time that the signal on line 56 is altered, which is the output of comparator 52, is determined by the time constant provided by the product of resistor R26 and capacitor C7. The voltage on line 56 drives through resistor R13 to the gate of FET Q1, which then opens and allows the power supply as provided by the battery 28 to start instantly a low frequency oscillator built around the amplifier 58. In the preferred embodiment, this FET is a Philips type ECG222. The oscillator frequency and waveform are determined by resistors R15, R16 and R17, and capacitor C9. The signal on line 60 consists of the oscillator output and drives the buzzer 18, which then generates a clearly audible pulsating high pitched sound and, through resistor R18, the LED D1, which functions as a flashlight 20. A pulsating sound is obtained since amplifier 58 produces a pulsating signal on line 60 that switches the buzzer 18 on and off, resulting in a high pitched, pulsating sound.

Pulsed sounds are preferable because these types of sounds are believed to have a stronger alerting effect on a person than a continuous sound, and the sound produced by buzzer 18 should be louder than the sound already present in the environment of the user of the device that exceeded the predetermined alarm level. Alternately, a vibrating transducer may be used with a suitably modified alarm circuit. Such a transducer may be provided with wires and be separable from the enclosure and placed on a nonabdominal part of the body for visually and auditorily handicapped users.

The types of electrical components used make it possible that many of the components could be integrated into a single chip and/or small surface-mount components could be used to produce a miniaturized device. Moreover, by altering the filters in the unit, the usefulness of the protective device could be extended to children and adults as well as to fetuses.

What is claimed is:

1. A sound level device to detect sound pressure levels on a moment-to-moment basis including levels exceeding a predetermined level to protect the hearing of a pregnant woman's fetus comprising;

microphone means responsive to ambient sound pressure levels for producing a first electrical signal representative of the sound pressure levels;

preamplifier means including weighting network means responsive to the first electrical signal for amplifying the first electrical signal, wherein the amplification of the first electrical signal corresponding to low frequency sound pressure levels is greater than the amplification of the first electrical signal corresponding to high frequency sound pressure levels;

level detector means responsive to the second amplified electrical signal for detecting levels of the second amplified signal corresponding to ambient sound pressure levels greater than 80 dB at a frequency of greater than 30 Hz and less than 1000 Hz and greater than 100 dB at a frequency of greater than 4000 Hz and less than 5000 Hz (db ref 20 μPa) and generating an alarm signal in response thereto; and alarm means responsive to the alarm signal.

2. The device of claim 1, wherein the weighting network amplifies the first electrical signal corresponding to low frequency sound pressure levels having frequencies greater than 30 Hz and less than 1000 Hz by greater than 5 dB and less than 20 dB more than the first electrical signal corresponding to high frequency sound pressure levels having frequencies greater than 1000 Hz.

3. The device of claim 2, wherein the alarm means comprises a pulsating, audible alarm emitting an alarm signal greater than 2.9 kHz and 3.9 kHz.

4. The device of claim 1, wherein the sound level device is adapted for mounting on clothing or in pockets of clothing worn by the pregnant woman covering her abdomen, the alarm means comprises an audible alarm adapted to provide audible emissions to the woman, and the alarm means is adapted to insulate audible emissions from the woman's abdomen.

5. The device of claim 2, wherein the sound level device is adapted for mounting on clothing or in pockets of clothing worn by the pregnant woman covering her abdomen, the alarm means comprises an audible alarm adapted to provide audible emissions to the woman, and the alarm means is adapted to insulate audible emissions from the woman's abdomen.

6. The device of claim 2, wherein the sound level device is adapted for mounting on clothing or in pockets of clothing worn by the pregnant woman covering her abdomen, the alarm means comprises an audible alarm adapted to provide audible emissions to the woman, and the alarm means is adapted to insulate audible emissions from the woman's abdomen.

7. The device of claim 2, wherein the alarm means comprises a visible light.

8. The device of claim 2, wherein the alarm means comprises both a pulsating, high-frequency audible alarm and a visible light.

9. The device of claim 2, wherein the alarm means comprises a vibrating transducer.

10. The device of claim 2, wherein the level detector means comprises an averager with a predetermined time constant to eliminate false alarm signals generated by the second amplified electrical signal corresponding to short-lasting peak sound pressures lasting approximately less than three seconds.

11. The device of claim 10, wherein the level detector means is adapted to generate an alarm signal when the sound pressure levels are greater than 80 dB at a frequency of greater than 30 Hz and less than 1000 Hz and are 100 dB at a frequency of greater than 4000 Hz and less than 5000 Hz (dB ref 20 μPa).

12. The device of claim 10, wherein the level detector means comprises an adjustment means whereby the sensitivity of the level detector means may be adjusted.

13. A method for detecting sound pressure levels on a moment to-moment-basis including levels exceeding a predetermined level to protect the hearing of a pregnant woman's fetus comprising:

producing a first electrical signal representative of ambient sound pressure levels;

selectively amplifying the first electrical signal to produce a second, amplified electrical signal, wherein the first electrical signal corresponding to low frequency sound pressure level are amplified a greater amount than the first electrical signal corresponding to high frequency sound pressure levels;

detecting levels of the second amplified electrical signal that correspond to ambient sound pressure levels greater than 80 dB at a frequency of greater than 30 Hz and less than 1000 Hz and greater than 100 dB at a frequency of greater than 4000 Hz and less than 5000 Hz (db ref 20 μPa) and generating an alarm signal in response thereto; and alerting the pregnant woman by generating the alarm signal in response to said alarm signal.

14. The method of claim 13, wherein the selective amplification step amplifies the first electrical signal corresponding to low frequency sound pressure levels greater than 30 Hz and less than 1000 Hz by greater than 5 dB and less than 20 dB more than the first electrical signal corresponding to high frequency sound pressure levels having frequencies greater than 1000 Hz.

15. The method of claim 14, wherein the pregnant woman is alerted by a pulsating, high-frequency audible alarm.

16. The method of claim 14, wherein the pregnant woman is alerted by a visible light.

17. The method of claim 14, wherein the pregnant woman is alerted by the vibration of a vibrating transducer.

18. The method of claim 14, wherein the detection step is performed by a level detector means comprising an averager with a predetermined time constant to eliminate false alarms generated by the second, amplified electrical signal corresponding to short-lasting peak sound pressures lasting approximately less than three seconds.

19. The method of claim 18, wherein the level detector means is adapted to generate an alarm signal when the sound pressure levels are greater than 80 dB at a frequency of greater than 30 Hz and less than 1000 Hz and are 100 dB at a frequency of greater than 4000 Hz and less than 5000 Hz (dB ref 20 μPa).

20. The method of claim 18, wherein the level detector means comprises an adjustment means whereby the sensitivity of the level detector means may be adjusted.

21. The method of claim 1, wherein the ambient sound levels are sound levels present in the vicinity of the pregnant woman's abdomen.

22. The method of claim 15, wherein the pregnant woman is alerted by using high frequency sounds which are insulated by said device from the woman's abdomen.

* * * * *